US005160095A

United States Patent [19]

Pepper

[11] Patent Number: 5,160,095

[45] Date of Patent: Nov. 3, 1992

[54] MACERATORS

[75] Inventor: Robert Pepper, Congleton, England

[73] Assignee: Mono Pumps Limited, England

[21] Appl. No.: 819,099

[22] Filed: Jan. 9, 1992

[51] Int. Cl.[5] ..... B02C 23/36

[52] U.S. Cl. ..... 241/46.06; 241/236; 241/291

[58] Field of Search ..... 241/46.06, 166, 167, 241/236, 291

[56] References Cited

U.S. PATENT DOCUMENTS 396,794 1/1889 Wissler ..... 241/291
570,828 11/1896 Tracy ..... 241/291
1,434,360 11/1922 Bach ..... 241/167
4,702,422 10/1987 Chambers, Sr. et al. ..... 241/46.06

*Primary Examiner*—Mark Rosenbaum
*Assistant Examiner*—John M. Husar
*Attorney, Agent, or Firm*—Jones, Day, Reavis & Pogue

[57] ABSTRACT

A macerator including two stacks of contra-rotating interleaved cutter discs having teeth is provided with two side rails closely adjacent to the periphery of the stacks of cutters. Each side rail has a plurality of angled ribs with slots therebetween. The ribs and slots are angled at an acute angle to the planes of the cutters so that each rib is passed by two or more cutters thereby to ensure maceration of any solids passing with the liquid in the slots.

10 Claims, 4 Drawing Sheets

MACERATORS

FIELD OF INVENTION

This invention relates to macerators suitable for macerating solids, but in particular, solids suspended in a liquid.

BACKGROUND OF THE INVENTION

One form of macerator as shown, for example, in GB-A-1569672, includes first and second parallel contra rotating shafts, each having a plurality of alternate cutters and spacers of the same axial thickness, the cutters of the first shaft being interleaved with those of the second shaft. Each cutter has a plurality of teeth arranged around its periphery and circumferentially spaced locations.

Mounted adjacent to the cutters, on the side walls of the housing, are side rails which have radially inner surfaces which are arcuate and closely adjacent to the teeth of the cutters as they rotate. While this has proved to be reasonably satisfactory, the flow rate, particularly of a liquid-borne, in particular water-borne, material to be macerated is reduced rather severely because of the general blockage provided by the cutters and the side rails.

It has been proposed according to US-A-4702422 to provide slotted side rails in which the side rails themselves are formed with a plurality of parallel ribs which extend in the same circumferential direction as the cutters and have formed therebetween a plurality of slots. These slots face the spacers and the ribs face the cutters in operation. The slots provide a passage for fine material which does not in fact need to be macerated and for the water and hence the flow rate through the macerating apparatus is significantly increased as compared with that of GB-A-1569672.

However a real problem exists in that it is very often desirable that some of the materials which may be in sheet form which can pass through the slots should be cut by the teeth of the macerator. The slots can thus provide an undesirable bypass flow for material which should be macerated and hence the macerated product can have a rather larger cross section than it should and sheet materials are not necessarily allowed to be macerated because of the fairly large space which is available for them to flow through the apparatus.

It is a primary object of the present invention to overcome this problem while still reducing the blockage which has occurred in earlier macerators.

SUMMARY OF THE INVENTION

According to the present invention there is provided a design of the side rails in which the ribs, and the slots therebetween, are angled relative to the planes of the cutter discs, whereby the cutter teeth of the cutter discs each pass in close proximity to a plurality of ribs.

Such a construction ensures that a thorough maceration of the material can take place and it is thereby not practical for flat or sheet like material to pass into one of the slots without being macerated.

In a preferred construction the ribs and slots are angled at between 15° and 45° with respect to the planes of the cutting discs.

While it is practical for the shafts to be mounted in any orientation, they are preferably mounted in a generally vertical plane. In this case, advantageously the angling of the ribs and slots therebetween is such as to extend downwardly in the direction of flow, that is to say in the direction of peripheral movement of the cutters as they pass the side rail.

In the preferred construction, the side rail has a top wall and a bottom wall which extends substantially in the same plane as the uppermost and the lowermost of the cutting discs respectively and that rib or those ribs which would normally intersect the top and bottom walls are made shorter, at their upper and lower ends, to define "header channels" thereby ensuring that each of the angled slots has an inlet and an outlet.

Advantageously each of the ribs is chamfered or bevelled at its free edge, the bevelling preferably extending downwardly at the free edge.

These and other advantages of the present invention will become more fully apparent to the man skilled in the art from the following detailed description which is given, merely by way of example, and with reference to the accompanying drawings.

DESCRIPTION OF A PRIOR ART CONSTRUCTION

Figure 1:
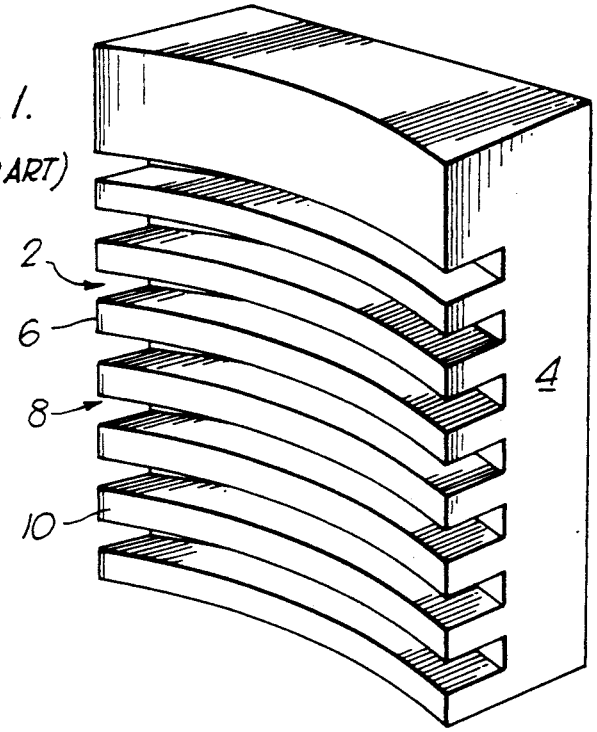
Fig. 1. (PRIOR ART)
FIG. 1 is a perspective view of a known form of slotted side rail of a maceration apparatus.
Figure 2:
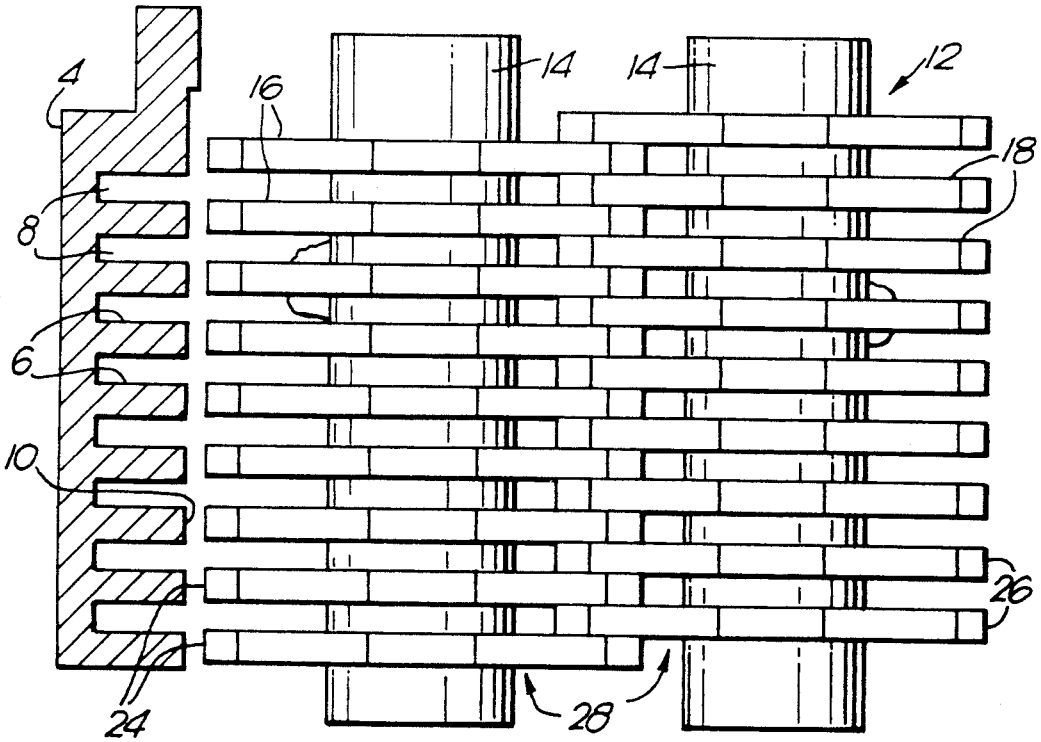
Fig. 2. (PRIOR ART)
FIG. 2 is a side elevation showing the slotted rail located adjacent to contra rotating shafts with a stack of cutting discs and spacers mounted thereon.

Referring to the prior art structure in FIGS. 1 and 2, one of a pair of slotted side rails is indicated by the general reference numeral 2 and has a rear wall 4. A plurality of ribs 6 of the side rail have corresponding slots 8 therebetween, the ribs having arcuate front edges 10. The slots 8 and the ribs 6 are parallel to cutting elements 16 and 18 of the macerator shown in FIG. 2. While FIG. 2 only shows one side rail, there will be a mirror image side rail mounted on the other side with the ribs 6 in facing relation to the cutter discs 18. The macerator 12 illustrated in FIG. 2 has two drive shafts 14 upon which cutting elements 16 and 18 are mounted. Planar spacers 20 and 22 are mounted between the cutting discs and are of the same thickness as the cutting discs. It will thus be seen that the discs 16, 18 are mounted opposite the ribs 6 and that the spacers 20, 22 are mounted opposite the slots 8. It will be appreciated that the cutting elements 16, 18 are spaced apart by the planar spaces 20, 22 respectively and these are fixedly mounted on the shaft 14. The cutting elements 16 and 18 are interleaved and the teeth 24 of the cutting elements are in close proximity to the bases of the other stack and in close proximity to the front edges 10 of the ribs 6. The ribs are aligned with the flow direction of liquid through the comminuting chamber and spaced to allow passage of liquid through the slots between the ribs. Liquid borne fine particles of solid material find passage through the slots 8 but the ribs prevent passage of larger pieces of unreduced material.

DETAILED DESCRIPTION OF THE PRESENTLY PREFERRED EMBODIMENT

Figure 3:
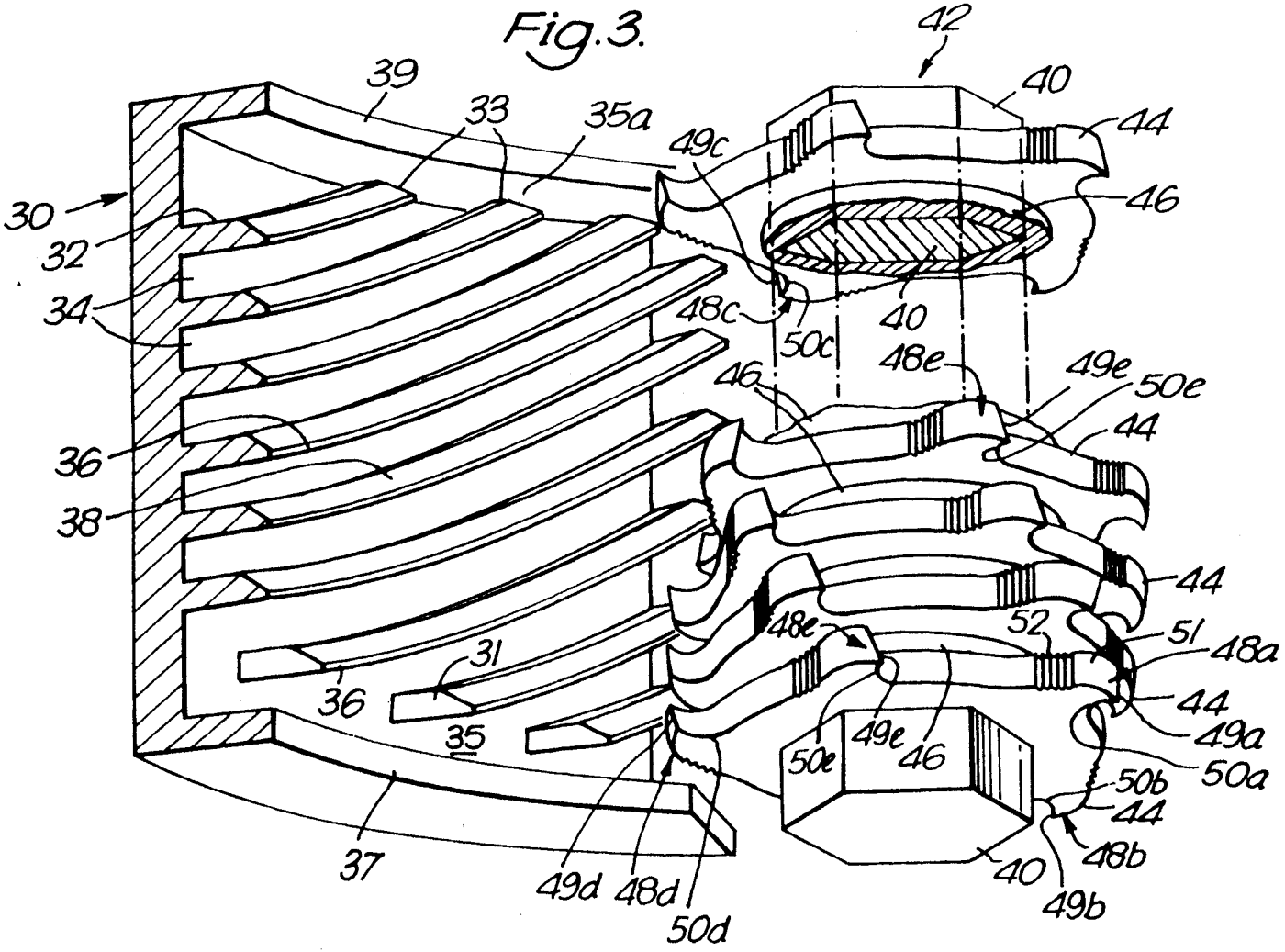
FIG. 3 is an exploded perspective view of one embodiment of side rail according to the present invention shown adjacent to a cutter stack.
Figure 4:
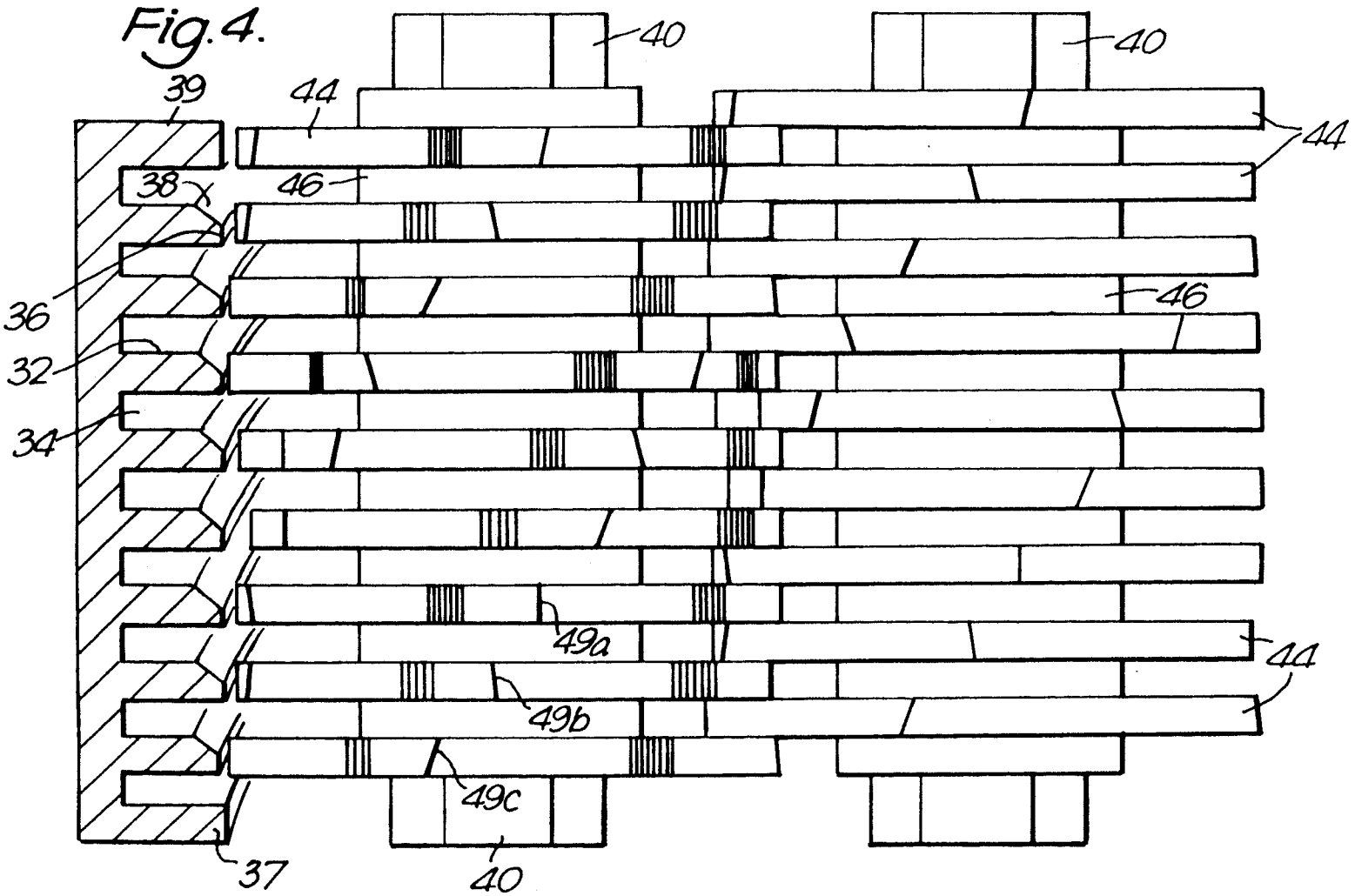
FIG. 4 is a view similar to FIG. 2 of the construction according to the invention shown in FIG. 3.

Reference is now made to FIGS. 3 and 4. A side rail according to the present invention is indicated by the general reference numeral 30 in which it is shown on FIG. 3, in an exploded perspective view of the rail and a macerator stack 42. Angled ribs 32 formed in the side rail define slots 34, the ribs 32 ensuring that liquid borne solid material flowing through a slot crosses a plane of at least two cutting elements 44. Crossing the plane of several cutting elements increases the likelihood that a piece of solid material will contact the cutting elements 44 several times and be adequately reduced to a manageable particle side. The angled ribs 32 present arcuately angled side rail surfaces 36 to the periphery of the macerator stack 42 which is mounted on shaft 40. The cutters 44 of the macerator stack 42 are each spaced from their neighbour by a spacer 46 defined by the thickness of the spacers 52 as shown in FIG. 4.

The angled ribs 32 are angled so that the surfaces 36 extend at an angle of between 15° and 45° to the planes of the cutting discs. The angle may be varied with arc length of the angled side rails 30 to ensure that a maximum number of recesses will cross the plane of more than one cutting element 44. A shorter arc length will require a steeper angle to ensure that sufficient crossings of the cutters and the ribs occurs, i.e. so that there are at least two and preferably several cutting planes.

In FIG. 3 the ribs have been shown angled so that they are higher on the right hand side. Because of the direction of rotation of the cutters this will tend to cause solid materials suspended in the liquid to flow down the slope of the ribs. However, the flow of liquid itself is such as to flow up the slope of the ribs. This orientation and resulting tendency of the solids to flow against the liquid flow will therefore have the advantage of causing the solids to more finally chopped by the interaction between the cutters and ribs. It should be understood, however, that it is also contemplated that the ribs could be oppositely oriented so that the solids are also caused to flow down the slope.

As shown, the front edge of each rib 32 is at least partly bevelled. The bevelled front edges 38 allow for a smaller space between the front edge of the ribs and the periphery of the teeth of the cutting elements without increasing the likelihood that solid material will become lodged between the angled ribs and the cutting elements. If the shafts 40 are vertical, as shown, the bevelled front edges 38 are preferably bevelled downwardly which serves to channel solid material within the slot of a lower angled rib and into contact with the cutting element 44.

Figure 5:
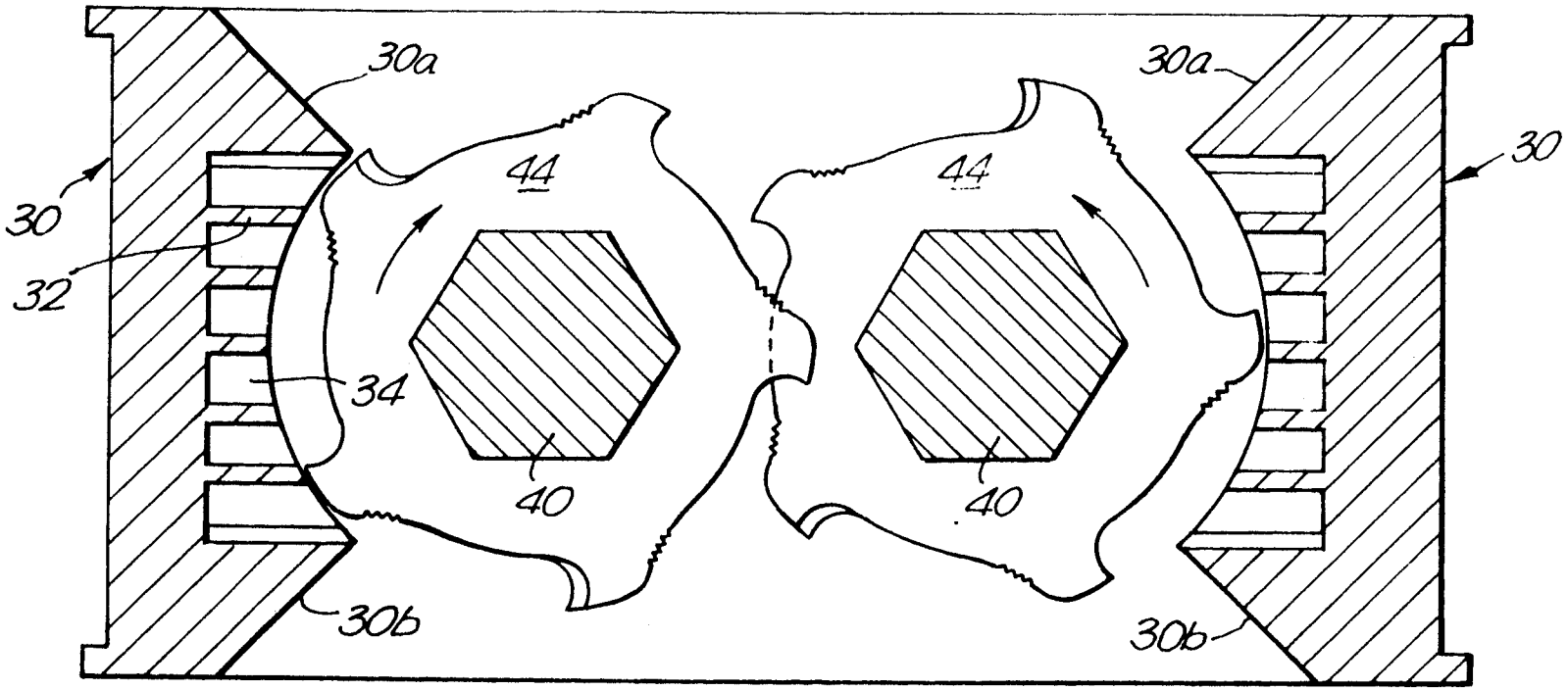
FIG. 5 is a reduced cross-section in a plane perpendicular to the axes of the stacks showing the relative positioning of the side rail ribs and slots and of the cutters.

In FIG. 5, angled ribs 32 and angled slots 34 are shown in a partial sectional view of the macerator stack in phantom, positioned in an operation mode, with the angled ribs of the side rail being shown in full lines. The angled ribs 32 along with the bevelled front edges 38 and the angled recesses 32 are shown differently in FIG. 5 with the associated shaft 40 and macerator stack 42 along with cutting elements 44 and cutting teeth 48. FIG. 5 provides a view of the improved macerator of the invention, and shows the angled slots 34 that ensure liquid borne solid material passing through a slot crosses the plane of at least two cutting elements 44 and its cutting teeth 48. It can be seen that the upper and lower faces 30*a* and 30*b* of the side rails are chamfered.

As can be seen from FIG. 3, each cutter of the stack is illustrated as having 5 circumferentially spaced teeth 48*a*, 48*b*, 48*c*, 48*d* and 48*e*. It can be seen that each tooth has a tip 49*a*, 49*b*, 49*c*, 49*d* and 49*e* respectively and a generally arcuate concave front face 50*a*, 50*b*, 50*c*, 50*d* and 50*e*. The front face 50*a* and tip 49*a* extends substantially parallel to the axis of the cutter, so that it is essentially "square". The front faces angled to one side of the axis of the cutter and the alternate front faces 50*c* and 50*e* are angled to the other side of the axis. The rear faces 51 are inclined to provide a ramp like configuration and are each provided with serrations 52, the angle of the serrations being approximately 60°. The rear faces 51 are arcuately convex between the serrations 52 and the tips 49.

It can be seen that the front faces 50*b*, 50*c*, 50*d* and 50*e* are inclined at approximately 30° to the axis in alternately opposite directions. When a plurality of these cutters are mounted as shown, there is provided a good scissor action and it will be observed that the cutting action takes place only in the one direction of rotation. This is bound to make the cutter strong and not too prone to damage. Because the backs of the cutting teeth are inclined and serrated, this assists in clearing the solid matter during reversal of the cutters due to overload. The one tooth 48*a* has a "square" cutting face and this improves the catchment of the solids and the drag of the item being macerated into the bank of cutters. Because the other teeth have alternate angles, this tends to equal out any side thrust and reduces the possibility of breakage.

While the angled ribs 32 and angled recesses 34 may be formed of cast metal these elements may be metal stamped or formed by other metallurgical processes. Rather than being unitary, the elements may be formed of component metal parts welded together but taking substantially the form shown.

It will be noted if reference is again made to FIGS. 3 and 4 that the shorter angled ribs 32 are themselves made rather shorter still so that their lower edges 31 of the lower ribs and the upper edges 33 of the upper ribs are spaced from a bottom wall 37 and a top wall 39 of the supporting rail. Thus there is formed, below the edges 31 and above the edges 33, "header" slots 35 and 35*a* which allow the liquid material to flow into and out of the shorter angled slots into the general flow of liquid.

Additionally, while the macerator with the angled ribs and slots is shown as having a generally rectangular housing which is transversely elongate, the housing could be generally cylindrical and the angle side rails and supporting wall could be semi-cylindrical in form. The side rails 30, it will be seen, have concave arcuate front edges 36 the curvature of which conforms substantially to the curvature of the locus of the teeth 48 so that the angled ribs 32 are only spaced a short distance from the path of movement of the teeth 48.

It will be appreciated that the provision of the angled ribs and slots ensures a far better maceration and reduces the likelihood of larger, particularly sheet like solid material, bypassing the cutters. Thus one can accurately control the maximum cross-section of the macerated material without materially reducing the rate of flow through the macerator.

While the macerator may be mounted in a housing having a completely enclosed chamber with an inlet and outlet, the apparatus of the present invention is equally mountable in an open topped channel with the axis of the cutter stacks extending vertically and the side rails mounted on either side of the channel.

The structure of the present invention is designed particularly to deal with raw sewage, sewage cleaning and sludge maceration and can, as indicated, be used in a channel or in a pipeline. It is believed that the structure of the present invention can operate over a wide range of capacities. For example, a capacity of up to 500 cubic meters per hour having a throat size ranging from 300 mm to 1500 mm can be provided wherein various sizing of the apparatus is taken into consideration when determining the dimensions of the side rails according to the invention. Any size of apparatus can be supplied to operate in a vertical or horizontal orientation or in an intermediate position between the vertical and horizontal.

I claim:

1. A macerator for macerating liquid borne solid material, said macerator comprising, in combination:

a) a macerating chamber;

b) side walls of said chamber;

c) first and second parallel contra-rotating shafts extending through said chamber between said side walls and mounted on parallel axes of rotation;

d) a plurality of alternate disc shaped, generally planar, cutters and spacers of the same axial thickness mounted on each of said first and second shafts, the planar cutters extending in planes perpendicular to said axes, the cutters of the first shaft being interleaved with those of the second shaft, said cutters comprising at least one tooth thereon, each tooth having a front cutting face;

e) side rails rigidly secured one to each side wall, each side rail comprising a plurality of spaced parallel ribs, the ribs forming therebetween slots, the radially inner edge surfaces of the ribs, with respect to the axes of rotation of the adjacent shaft, being concave, the concave edge faces of the ribs closely conforming to the path of movement of the tips of the cutter teeth, as they rotate past said side rail; and f) edge faces of said ribs in close proximity to the teeth on the cutters as the teeth pass adjacent thereto, the parallel ribs of each side rail being angled at an acute angle to the planes of the cutters of the adjacent shaft, effective to ensure that liquid borne solid material passing along each of said slots crosses the planes of at least two of said cutter elements.

2. A macerator as claimed in claim 1, wherein the acute angle is between 15° and 45°.

3. A macerator as claimed in claim 1, wherein the length of the concave surface, as measured around the circumference of the cutter, is inversely proportional to the angle of inclination.

4. A macerator as claimed in claim 1, wherein the first and second shafts are mounted vertically and wherein the ribs of the side rails are inclined downwardly in the direction of movement of the cutter teeth adjacent thereto.

5. A macerator as claimed in claim 4, wherein each side rail includes a side surface, a top wall and a bottom wall, wherein at least some of the slots open into a side surface of the side rail to permit passage therefrom of material in the slots, and wherein the top wall and the bottom wall of each side rail are spaced from the upper and lower edges of those angled ribs which do not extend to the side of the side rail, thereby to provide a header passage for material flowing in the slots associated therewith.

6. A macerator as claimed in claim 1, wherein the free edges of the ribs are bevelled.

7. A macerator as claimed in claim 6, wherein the first and second shafts are mounted vertically and the bevels are formed on the upper edges of the ribs.

8. A macerator as claimed in claim 1, wherein each cutter comprises several circumferentially spaced teeth, each tooth having a generally ramp shaped, inclined rear face, and the front face of at least one tooth extending substantially parallel to the axis of the cutter and the front faces of a plurality of the other teeth being inclined to the axis of the cutter.

9. A macerator as claimed in claim 1, wherein said macerating chamber comprises the side walls of a channel.

10. A macerator as claimed in claim 1, wherein the macerating chamber comprises the interior of a housing having an inlet and an outlet port on opposite sides of the nip formed between the rotating cutters.

* * * * *